US010378259B2

(12) United States Patent
Miglioranzo

(10) Patent No.: US 10,378,259 B2
(45) Date of Patent: Aug. 13, 2019

(54) HINGE FOR THE ROTATABLE MOVEMENT OF A DOOR, A SHUTTER OR THE LIKE

(71) Applicant: Ivano Miglioranzo, Valeggio sul Mincio (IT)

(72) Inventor: Ivano Miglioranzo, Valeggio sul Mincio (IT)

(73) Assignee: OL.MI. S.R.L., Castelnuovo del Garda (IT)

( * ) Notice: Subject to any disclaimer, the term of this patent is extended or adjusted under 35 U.S.C. 154(b) by 0 days.

(21) Appl. No.: 15/052,649

(22) Filed: Feb. 24, 2016

(65) Prior Publication Data

US 2016/0168897 A1 Jun. 16, 2016

Related U.S. Application Data

(63) Continuation of application No. PCT/IB2015/052792, filed on Apr. 16, 2015.

(30) Foreign Application Priority Data

Apr. 16, 2014 (IT) ..... VI2014A0113

(51) Int. Cl.
*E05F 1/10* (2006.01)
*E05F 3/10* (2006.01)
*E05D 11/10* (2006.01)

(52) U.S. Cl.
CPC ..... *E05F 3/104* (2013.01); *E05D 11/1064* (2013.01); *E05F 1/105* (2013.01); *E05Y 2201/638* (2013.01); *E05Y 2201/688* (2013.01); *E05Y 2900/132* (2013.01); *E05Y 2900/146* (2013.01)

(58) Field of Classification Search
CPC . E05F 1/008; E05F 1/10; E05F 1/1041; E05F 1/105; E05F 1/08
USPC ..... 16/378, 379
See application file for complete search history.

(56) References Cited

U.S. PATENT DOCUMENTS 2,035,823 A * 3/1936 Moore ..... E05D 11/1064 16/200
3,724,023 A * 4/1973 Tillmann ..... E05F 3/104 16/52
5,802,670 A * 9/1998 Bienek ..... E05F 3/10 16/53

(Continued)

FOREIGN PATENT DOCUMENTS

DE 202010011929 U1 1/2011

*Primary Examiner* — Emily M Morgan
(74) *Attorney, Agent, or Firm* — Mark David Torche; Patwrite Law

(57) ABSTRACT

A closing hinge including a hinge body and a pivot reciprocally coupled to rotate around a first axis; a working chamber defining a second axis perpendicular to the first axis; a cam member unitary rotating with the pivot; a cam follower wheel sliding along the second axis between a position proximal to the rear wall of the working chamber and a distal position thereto; a thrust spring acting on the cam follower wheel. The cam member includes a first abutment element and a second abutment element respectively including a second curved portion and a third curved portion for selectively contacting the cam follower wheel in a respective single tangency point at a first and a second open positions and for contacting the wheel in two tangency points opposite with respect to the second axis at a closed position.

5 Claims, 6 Drawing Sheets

(56) References Cited

U.S. PATENT DOCUMENTS

| | | | | |
|---|---|---|---|---|
| 5,867,869 | A | 2/1999 | Garrett et al. | |
| 7,003,847 | B2 * | 2/2006 | Brown | E05F 3/104 16/284 |
| 8,191,206 | B1 * | 6/2012 | Bacchetti | E05D 11/1014 16/378 |
| 8,863,356 | B2 * | 10/2014 | Bacchetti | E05F 3/104 16/54 |
| 8,984,717 | B1 * | 3/2015 | Jackson | E05F 1/1253 16/273 |
| 9,353,565 | B2 * | 5/2016 | Bacchetti | E05F 3/104 |
| 2007/0228742 | A1 * | 10/2007 | Chiang | E05D 5/0246 292/163 |
| 2008/0127452 | A1 * | 6/2008 | Jackson | E05F 1/1253 16/50 |
| 2010/0024159 | A1 * | 2/2010 | Oh | E05D 5/0246 16/54 |

* cited by examiner

HINGE FOR THE ROTATABLE MOVEMENT OF A DOOR, A SHUTTER OR THE LIKE

CROSS REFERENCE TO RELATED APPLICATIONS

This application is the U.S. national phase of international application PCT/IB2015/052792 filed Apr. 16, 2015 which designated the U.S., and claims the priority of Italian patent application No. VI2014A000113 filed Apr. 16, 2014, the entire contents of both of which are hereby incorporated by reference.

FIELD OF INVENTION

The present invention is generally applicable to the technical field of closing or checking hinges, and particularly relates to a hinge for the rotatable movement of a door, a shutter or the like.

BACKGROUND OF THE INVENTION

Closing hinges are known that include a box-shaped hinge body and a pivot reciprocally coupled to allow a closing element, such as a door, a shutter or the like, to rotate between an open position and a closed position.

Generally, these hinges include a hinge body and a pivot reciprocally coupled to allow the closing element to rotate between the open and the closed positions.

These known hinges further include a working chamber internal to the box-shaped hinge body that slidingly houses a plunger member.

Examples of such hinges are known from documents EP0756663, U.S. Pat. No. 5,867,869 and EP2148033.

These hinges are susceptible to be improved, particularly with regard to their duration through time.

SUMMARY OF THE INVENTION

Object of the present invention is to at least partially overcome the above-mentioned drawbacks, by providing a highly functional and low cost hinge.

Another object of the invention is to provide a hinge having an extremely high duration through time.

Another object of the invention is to provide a low-bulkiness hinge.

Another object of the invention is to provide a hinge having high thrust force.

Another object of the invention is to provide a hinge which ensures the automatic closing of the closing element from the open door position.

Another object of the invention is to provide a hinge capable to support even very heavy closing elements, without changing its behavior.

Another object of the invention is to provide a hinge having a minimum number of constituent parts.

Another object of the invention is to provide a hinge capable to maintain the exact closing position through time.

Another object of the invention is to provide an extremely safe hinge.

Another object of the invention is to provide a hinge extremely easy to install.

These objects, and others which will appear more clearly hereinafter, are fulfilled by a hinge in accordance with what is herein described and/or claimed and/or shown.

Advantageous embodiments of the invention are defined in accordance with the dependent claims.

BRIEF DESCRIPTION OF THE DRAWINGS

Further features and advantages of the invention will appear more evident reading the detailed description of some preferred not-exclusive embodiments of a hinge 1, which are shown as a non-limiting example with the help of the annexed drawings, wherein.

DETAILED DESCRIPTION OF THE INVENTION

Figures 1, 2:
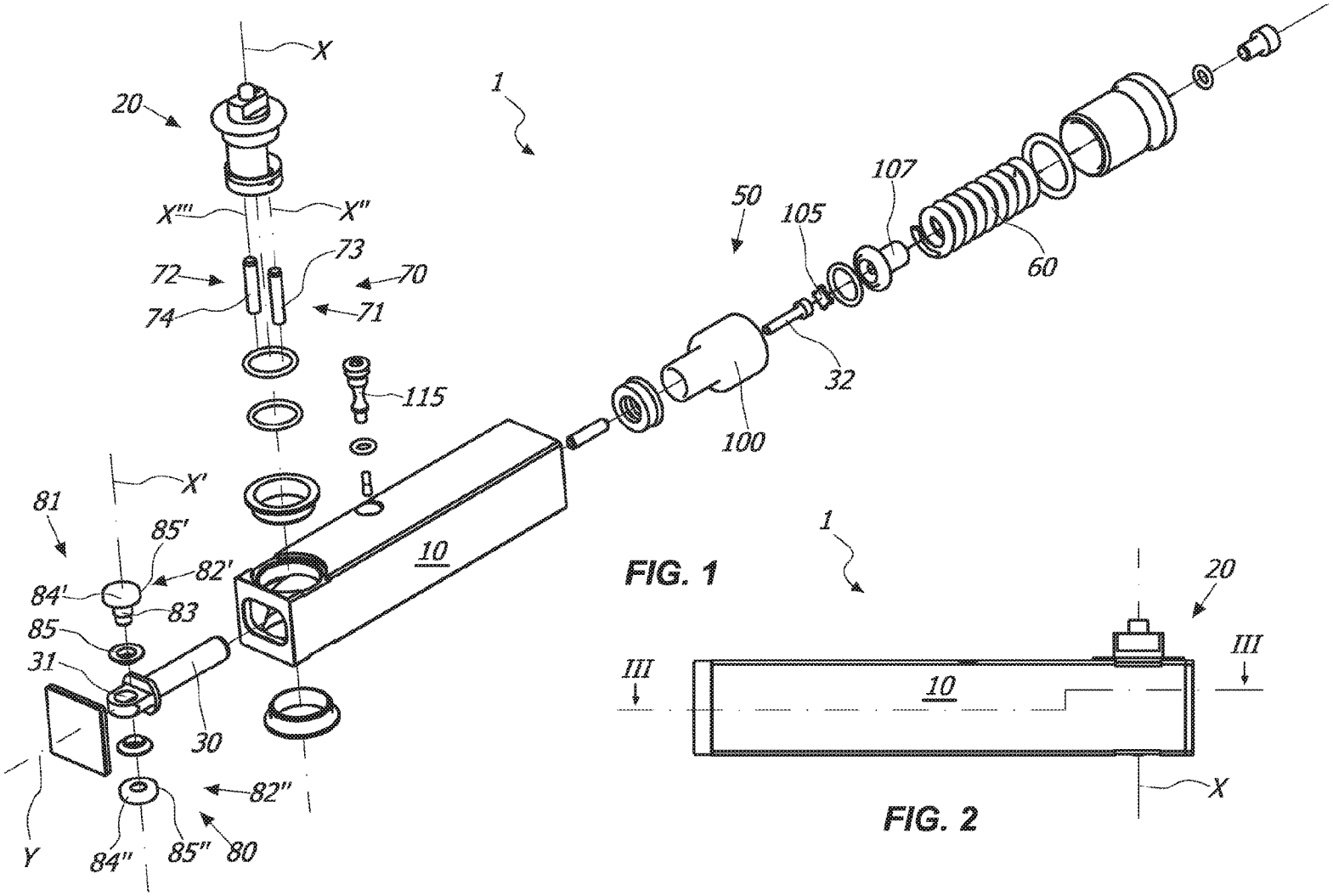
FIG. 1 is an exploded axonometric view of an embodiment of the hinge 1.
FIG. 2 is a side view of the embodiment of the hinge 1 of FIG. 1.

With reference to the above figures, the hinge 1 is advantageously used for checking the rotatable movement of at least one closing element, such as a door, a shutter or the like, which can be anchored in a per se known manner to a stationary support structure, such as a wall, a floor, a frame or the like.

As non-limiting example, the hinge 1 may be used for glass doors, internal doors in wood, aluminum or PVC, shower shutters or cold room doors.

In the annexed figures the closing element and the stationary support structure have not been shown, as they are per se known. It is understood that both these elements are not part of the invention claimed in the appended claims.

Therefore, the hinge 1 may include a box-shaped hinge body 10 anchorable to one of the stationary support structure and the closing element, and a pivot 20 anchorable to the other of the stationary support structure and the closing element.

In all the embodiments shown in the annexed figures the box-shaped hinge body 10 is anchored to the stationary support structure, while the pivot 20 is anchored to the closing element. Therefore, the box-shaped hinge body 10 is fixed, while the pivot 20 is rotatable.

However, it is understood that the box-shaped hinge body 10 may be anchored to the closing element, while the pivot 20 may be anchored to the stationary support structure without departing from the scope of the appended claims.

Suitably, the pivot 20 and the box-shaped hinge body 10 are reciprocally coupled to rotate around the axis X, which for example may be substantially vertical.

Advantageously, the axis X may also define the axis of rotation of the closing element.

The hinge 1 also includes a working chamber 40 having an axis Y, which may be substantially perpendicular to axis X, for example substantially horizontal. Within the working chamber 40, which may be internal to the box-shaped hinge body 10, a plunger member 50 can slide along the axis Y, whereon elastic counteracting means 60 may act.

In this way, the plunger member 50 may slide along the axis Y between a position proximal to the bottom wall 45 of the working chamber 40 and a position distal from it. In the embodiments shown in the figures, provided for the sole purpose of illustration and not limiting of the invention, the proximal position may correspond to the position wherein the closing element is open, while the distal position may correspond to the position of closing element closed.

Likewise, the proximal position may correspond to the maximum compression of the elastic counteracting means 60, while the distal position may correspond to the maximum elongation of the elastic counteracting means.

Depending on the configuration of the elastic counteracting means 60, the hinge 1 may be a closing hinge or a checking hinge.

In fact, the elastic counteracting means 60 may include one or more thrust springs, that is susceptible to return the closing element in the closed position from the open position, or vice versa, or a return spring, susceptible to restore the original position of the plunger member 50 but not susceptible to return the closing element in the closed position from the open one, or vice versa.

In a preferred but not exclusive embodiment, the plunger member 50 may include a cylindrical body 100, preferably sealingly inserted into the working chamber 40.

The pivot 20 and the plunger member 50 may be mutually engaged so that the rotation of the pivot around the axis X corresponds to the sliding of the plunger member along the axis Y between the proximal and the distal positions, and vice versa the sliding of the plunger member along the axis Y between the proximal and the distal positions corresponds to the rotation of the pivot around the axis X.

Figure 4:
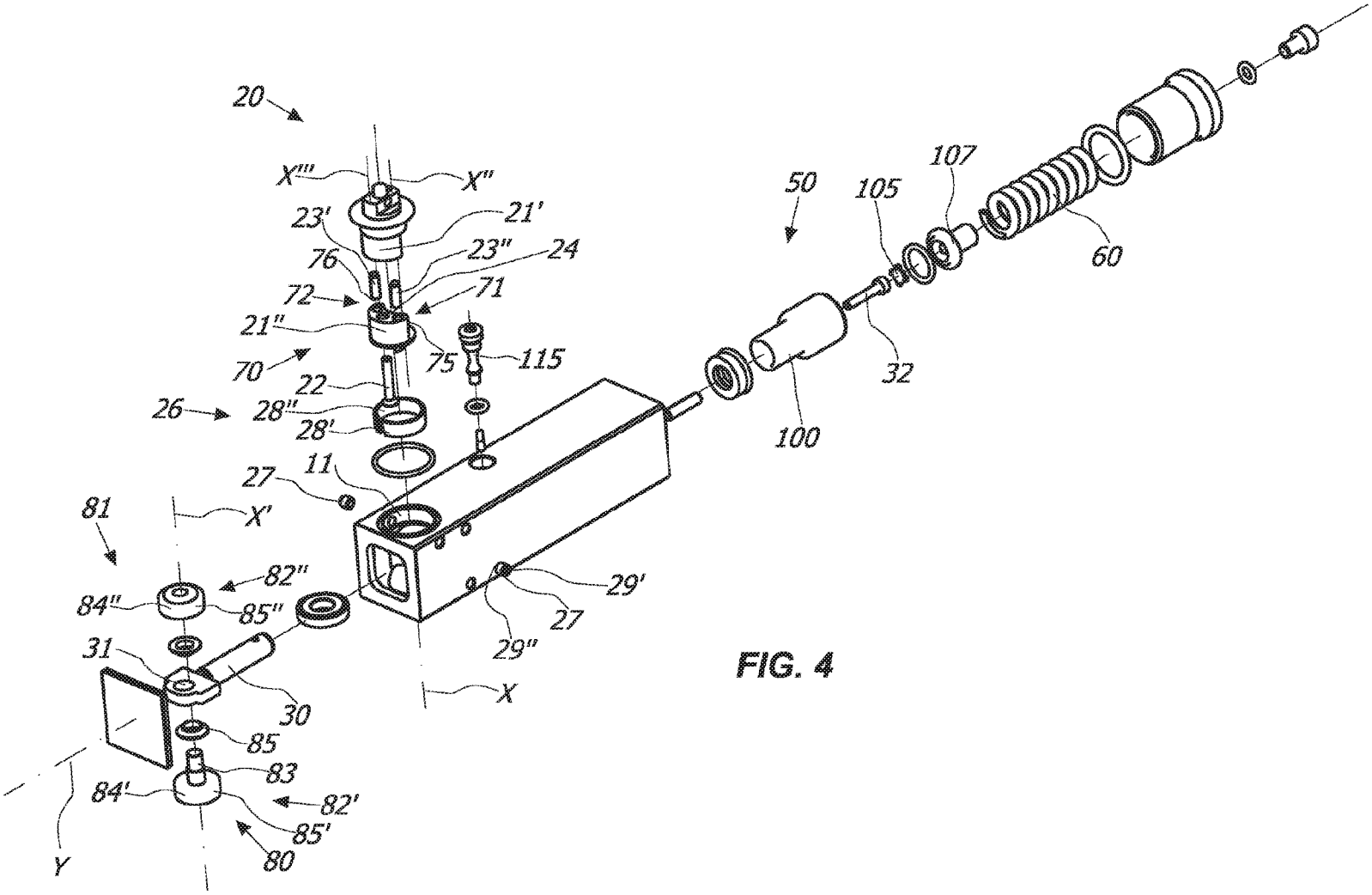
FIG. 4 is an exploded axonometric view of a further embodiment of the hinge 1.

For such purpose, the pivot 20 may include a cam 70 (FIGS. 1 and 4) rotating around the axis X to return the plunger member 50 from the distal position to the proximal position.

A cam follower means 80 may be provided that interacts with the cam 70 and is integrally coupled with the plunger member 50, for example via a shaft 30, to slide along the axis Y therewith between the proximal and the distal positions.

Suitably, the elastic counteracting means 60 may act on the plunger member 50 to return it from the proximal position to the distal one.

In a preferred but not exclusive embodiment, cam follower means 80 may include a rotatable element or wheel 81 rotating around an axis X' substantially parallel to the axis X and spaced apart therefrom.

Advantageously, the rotatable element 81 may have a cylindrical shape. For example, it can be constituted by a wheel, which in its turn may provide for a male member 82' and a female member 82" to mutually overlap and couple. Due to this feature, the forces resulting from the interaction with the cam 70 are equally distributed between the male 82' and female 82" members, with an obvious benefit for the time duration of the hinge 1.

Suitably, the wheel 81 may be rotatably housed in a seat 31 at the end of the shaft 30 to rotate around the axis X'.

The wheel 81 may have a central cylindrical portion 83 insertable into the seat 31 and two disk-shaped upper and lower portions 84', 84" of greater diameter than the central portion susceptible to come in contact engage and with the cam 70.

Advantageously, the wheel 81 may rotate around the axis X' on bushings 85, so as to minimize the friction.

The cam 70 may include a first and a second abutment element 71, 72 both susceptible to come into contact engage with the wheel 81.

On the other hand, the wheel 81 may include a single disk-shaped portion without departing from the scope of the appended claims. It is understood, however, that the wheel 81 with the two overlapped disk-shaped portions ensures an optimum distribution of the forces, and therefore in general a long life of the hinge 1.

Advantageously, the first and the second abutment elements 71, 72 can both have at least one respective curved portion.

For example, in the embodiment shown in FIGS. 1 to 3B they may be exemplified by a pair of cylindrical pins 71, 72 having respective axes X" and X'" substantially parallel to the axis X and substantially perpendicular to the axis Y, and which may be susceptible to selectively interact with the wheel 81

More particularly, the pins 71, 72 may have respective side walls 73, 74 (FIG. 1) susceptible to come into contact and engage with peripheral edges 85', 85" of the upper and lower portions 84', 84" of the wheel 81.

On the other hand, in the embodiment shown in FIGS. 4 to 6B the first and the second abutment elements 71, 72 may be defined by at least an area of the respective convex curved portions of the ends 75, 76 of the cam 70 interposed between a concave portion 24.

The areas of the convex curved portions of the ends 75, 76 may correspond to one or more contact points of the peripheral edges 85', 85" of the upper and lower portions 84', 84" of the wheel 81. On the other hand, those areas may correspond to a continuous portion more or less extending from the convex curved portions of the ends 75, 76.

Regardless, the areas of the convex curved portions of the ends 75, 76 may have respective axes X" and X'" substantially parallel to the axis X and substantially perpendicular to the axis Y, and may be susceptible to come into contact engage with the peripheral edges 85', 85' of the upper and lower portions 84', 84" of the wheel 81.

In this way, both upon the opening and the closing of the closing element, that is upon the rotation of the cam 70 around the axis X, and in particular upon rotation of the two abutment elements 71, 72, the cam corresponds to the rotation of the wheel 81 around the axis X', as well as to the translation of the wheel along the axis Y.

Figure 3A:
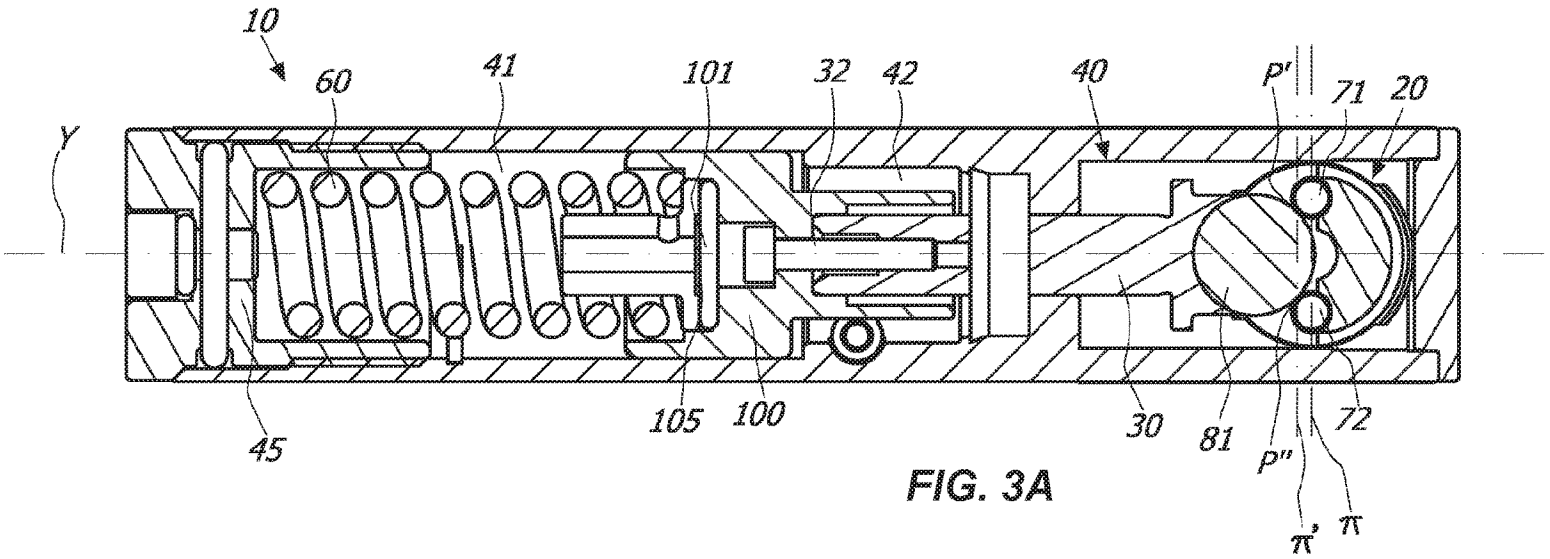
FIG. 3A is a sectioned view of the embodiment of the hinge 1 of FIG. 1 sectioned along a plane III-III.
Figure 3B:
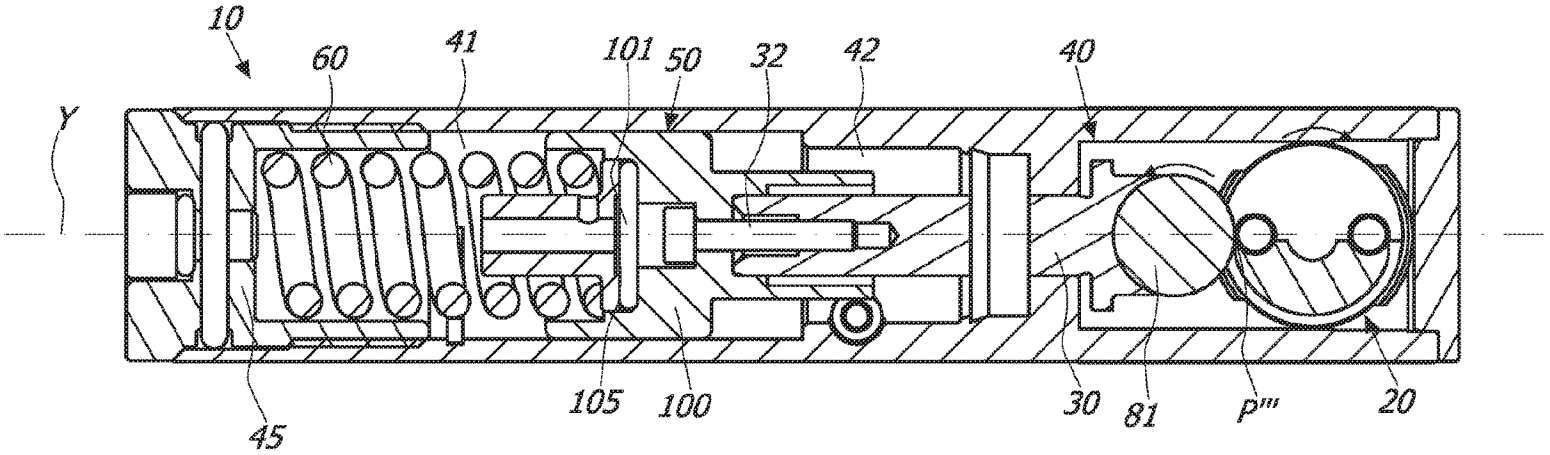
FIG. 3B is a sectioned view of the embodiment of the hinge 1 of FIG. 1 sectioned along a plane III-III.
Figure 5A:
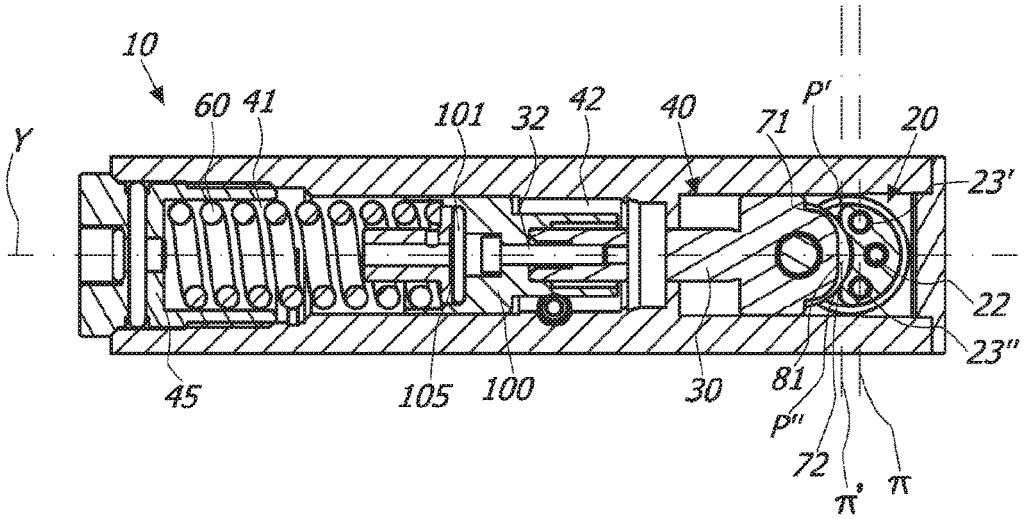
FIG. 5A is a sectioned view of the embodiment of the hinge 1 of FIG. 4 sectioned along a plane substantially parallel to axis Y and substantially perpendicular to axis X.
Figure 5B:
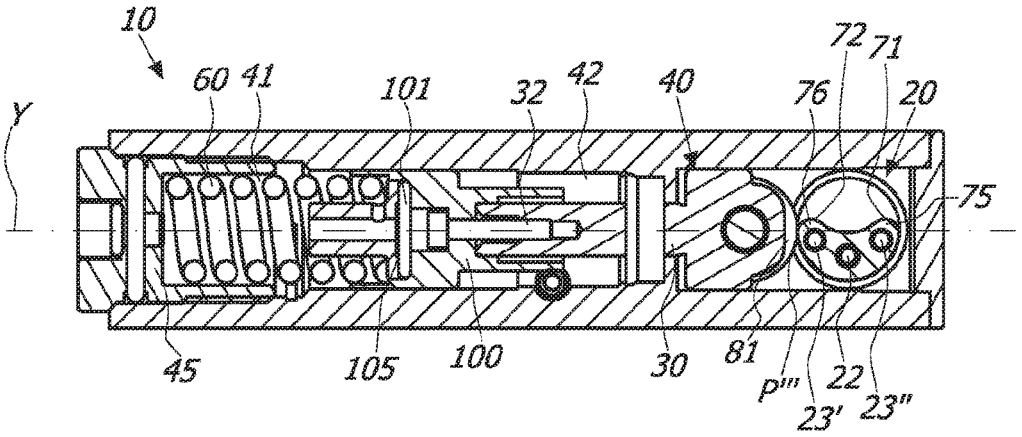
FIG. 5B is a sectioned view of the embodiment of the hinge 1 of FIG. 4 sectioned along a plane substantially parallel to axis Y and substantially perpendicular to axis X.
Figure 6A:
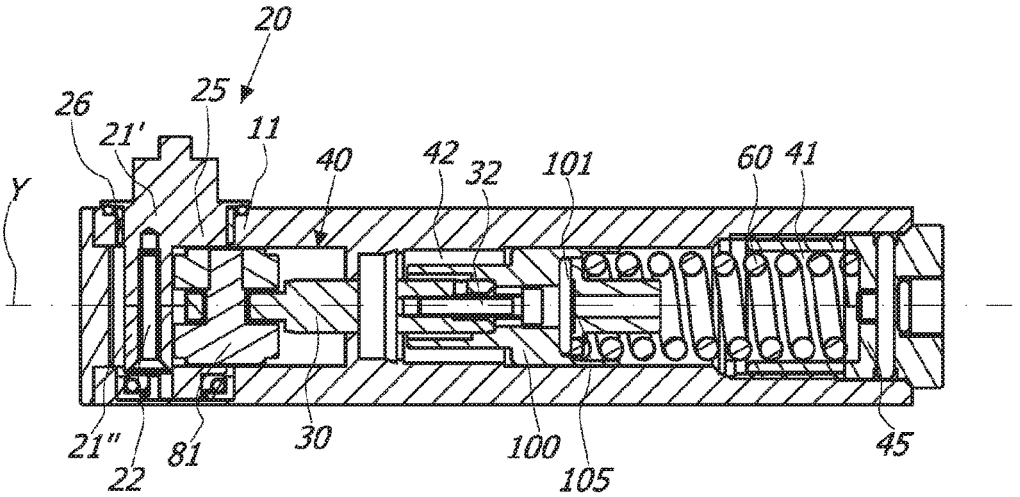
FIG. 6A is a sectioned view of the embodiment of the hinge 1 of FIG. 4 sectioned along a plane substantially parallel to axis X and axis Y.
Figure 6B:
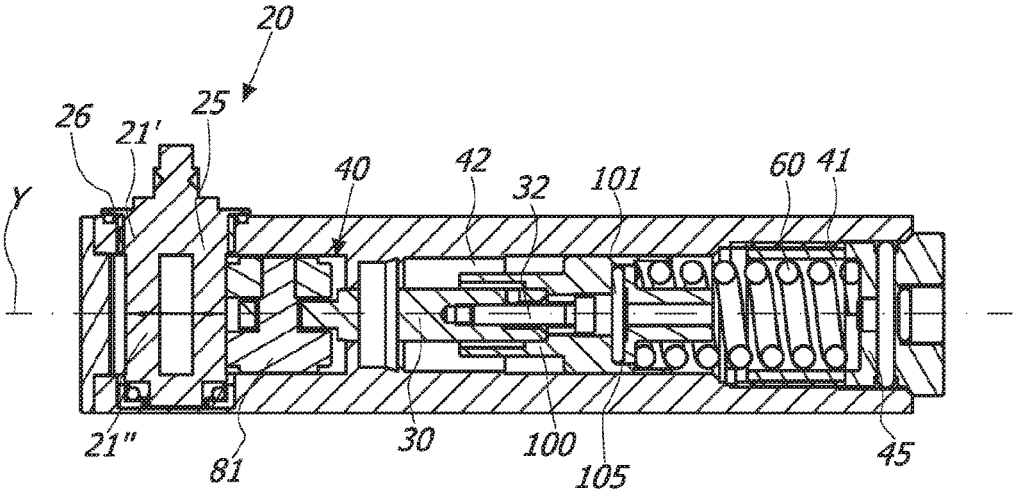
FIG. 6B is sectioned view of the embodiment of the hinge 1 of FIG. 4 sectioned along a plane substantially parallel to axis X and axis Y.

More particularly, upon the opening and closing of the closing element, that is, upon the rotation of the pivot 20 around the axis X, the axes X" and X'" rotate with respect to the axis X between a rest position, shown for example in FIGS. 3A, 5A and 6A, wherein the closing element is in the closed position, wherein the two axes X" and X'" are spaced apart from the axis Y and equidistant thereto, and a working position, shown for example in FIGS. 3B, 5B and 6B, wherein the closing element is in the open position, whereby the two axes X" and X'" are aligned so that they both intersect the axis Y.

In the embodiments shown, the hinge 1 is configured so that the closing element can rotate between a closed position, shown for example in FIGS. 3A, 5A and 6A, and two open positions opposite to each other with respect to the closed position, one of which is shown as an example in FIGS. 3B, 5B and 6B.

From the figures it is evident that the wheel 81 is in contact with both the abutment elements 71, 72 when the closing element is in the closed position and is in contact with only one of the abutment elements 71, 72 when the closing element is in each of the open positions.

At the same time, upon the opening and closing of the closing element, that is, upon the rotation of the pivot 20 around the axis X, the rotation of abutment elements 71, 72 corresponds to the translation of the axis X' of the wheel 81 along the axis Y between a position wherein the axis X' is proximal to the axis X, shown for example in FIGS. 3A, 5A and 6A and coincident with both the distal position of the plunger member 50 and with the closing element in the closed position, and a position wherein the axis X' is distal from the axis X, shown in FIGS. 3B, 5B and 6B and coincident with both the proximal position of the plunger member 50 and with the closing element in the open position.

It is obvious that the rotation of the wheel 81 around the axis X' minimizes the friction between the parts in contact, namely, contact between the wheel 81 and the abutment elements 71, 72, so as to maximize the time duration/life of the hinge 1.

The minimization of the friction between the parts in contact also allows maximizing the thrust force of the elastic counteracting means 60. In other words, the hinge 1 develops a thrusting force much higher than that of the hinges of the prior art.

To further minimize the friction, the contact between the abutment elements 71, 72 and the wheel 81 may occur at mutual tangency points P', P", (FIGS. 3*a* and 5*a*—closed door position), P"' (FIGS. 3*b* and 5*b*—open door position). That is to say the contact is at respective single contact points at the periphery of abutment elements or pins 71, 72 (i.e. at points on their respective side walls 73, 74) and the wheel 81 (i.e. at points on the peripheral edges 85', 85" of the upper and lower portions 84', 84" of the wheel). This ensures that the contact occurs in a single point.

Reiterating, the points P' and P" are the contact points between the abutment elements/pins 71, 72 and the wheel 81 in the position of closing element closed, as shown in FIGS. 3*a* and 5*a*. And, the point P"' is the contact point between the abutment element 72 and the wheel 81 in one of the positions of the closing element in the open position, as shown in FIGS. 3B and 5B.

It is understood that due to the rotation of the wheel 81 the point P"' is different both from point P' and P".

It is understood that with the closing element/door swung in the other open position/direction, opposite to that shown in FIG. 3B, the wheel 81 is in contact with the abutment element 71 at a different single contact point.

In a preferred but not exclusive embodiment, the abutment elements/pins 71, 72 may be mutually positioned so that their respective axes X" and X"' define a plane π (FIG. 5*a*) substantially parallel to the axes X and X' and substantially perpendicular to axis Y.

Suitably, also, the tangency points P', P" may define a plane π' (FIG. 5*a*) that is also substantially parallel to the axis X and substantially perpendicular to the axis Y. The planes it and π' may be parallel to each other when the axis X' is in the proximal position, that is when the plunger member 50 is in distal position, as shown for example in FIGS. 3A and 5A.

The hinge 1 may be mechanic or hydraulic.

In case of a hydraulic hinge, the working chamber 40 may include a working fluid, generally oil, acting on the plunger member 50 to counteract the rotational action of pivot 20, thus hydraulically checking the closing or opening movement of the closing element.

The cylindrical body 100 acts as separation element of the working chamber 40 into a first and a second variable volume compartment 41, 42. These compartments 41, 42, which fluidly communicate with each other, are preferably adjacent.

Advantageously, the first variable volume compartment 41 and the second variable volume compartment 42 may be configured so as to have in correspondence with the closed position of the closing element with their respective maximum and minimum volume. The elastic counteracting means 60 may be placed in the first compartment 41.

Suitably, the cylindrical body 100 may be sealingly inserted in the working chamber 40.

In the present text, with the expression "cylindrical body sealingly inserted" and its derivations indicates that the cylindrical body 100 is inserted into the working chamber 40 with minimum play, such as to allow the cylindrical body to slide therein but to prevent passage of the working fluid through the casing between the side surface of the cylindrical body and the inner surface of the working chamber.

In a preferred but not exclusive embodiment, the cylindrical body 100 may include at least one first passage or opening 101 (FIGS. 3*a*, 3*b*, Sa, Sb, 6*a* and 6*b*) to allow the passage of the working fluid between the first and the second compartment 41, 42 upon one of the opening or the closing of the at least one closing element.

To allow the passage of the working fluid between the first and the second compartment 41, 42 during the opening or closing of the at least one closing element, a hydraulic circuit passing through the hinge body 10 may be provided.

In the preferred but not exclusive embodiments, upon the opening of the closing element the working fluid passes from the first compartment 41 to the second compartment 42 through the opening 101, while upon the closing of the closing element the working fluid passes from the second compartment 42 to the first compartment 41 through the hydraulic circuit.

It is understood, however, that upon the opening of the closing element the working fluid may pass from the first compartment 41 to the second compartment 42 through the hydraulic circuit, while upon the closing of the closing element the working fluid may pass from the second compartment 42 to the first compartment 41 through the opening 101 without departing from the scope defined by the appended claims.

It may also be provided that upon that opening of the closing element the working fluid may pass from the second compartment 42 to the first compartment 41 through one of the hydraulic circuit and the at least one opening 101, whereas upon the closing of the closing element the working fluid may pass from the first compartment 41 to the second compartment 42 through the other of the hydraulic circuit and the at least one opening 101, without departing from the scope defined by the appended claims.

It may also be provided an adjustment screw 115 (FIG. 1) to adjust the passage section of the hydraulic circuit, so as to regulate the return speed of the working fluid.

Adjustment screw 115 allows regulating the flow of the working fluid through the hydraulic circuit in a simple and rapid manner, with the maximum guarantee of constancy through time of the behavior of the closing element during the closing and/or opening movement.

More details on the particular configuration of the adjustment screw 115 are shown in the Italian Application VI2013A000195, on behalf of the same Applicant, wherein reference is made for consultation.

Advantageously, the cylindrical body 100, may include valve means, which can be constituted by a non-return valve 105, interacting with the opening 101 to selectively prevent the passage of the working fluid therethrough upon the closing of the closing element, thus forcing the passage of the working fluid through the hydraulic circuit.

The non-return valve 105 may be further configured to selectively allow the passage of the working fluid through the opening 101 upon the opening of the closing element.

In a preferred but not exclusive embodiment, the non-return valve 105 may provide a stopper forced upon the closing by a small spring, as taught by the international application PCT/IB2015/052674, in the name of the same Applicant.

In a preferred but not exclusive embodiment, the shaft 30 may be connected to the cylindrical body 100 by a screw 32.

More details on the configuration of these elements, and in particular regarding the configuration of the opening 101, of the non-return valve 105 and of the mechanical connection between the cylindrical body 100, the shaft 30 and an interface element 107, are shown in the international application PCT IB2012/051006, in the name of the same Applicant, wherein reference is made for consultation.

In a further preferred but not exclusive embodiment, the shaft 30 may be directly connected to the cylindrical body 100 through threading and counter-threading, as taught by the international application PCT/IB2015/052674, in the name of the same Applicant.

Thanks to these features, it is possible to effectively check the flow of the working fluid between the first and the second compartment 41, 42 in both directions.

In a preferred but not exclusive embodiment, shown for example in FIGS. 6*a* and 6B, the pivot 20 may be constituted of two half-portions 21', 21" assembled together.

A means for coupling the assembled two half-portions 21', 21 may be provided, for instance via a screw 22 and a pair of anti-rotation pins 23', 23" (FIGS. 51 and 5*b*). In this way, the two half-portions 21', 21" become mutually integral.

This allows use of the cam 70 in any form, and in particular the form shown in FIGS. 4 to 6B. In this case, in fact, with a unitary pivot it would be extremely difficult to manufacture the concave portion 24 interposed between the convex curved portions of the ends 75, 76.

The pivot 20 constituted of the two half-portions 21', 21" results in a more solid and long-lasting pivot than the unitary pivot, as it allows a better distribution of the forces which develop during the interaction with the plunger member 50.

It is understood that the hinge 1 may be manufactured with the unitary pivot 20 or in two half-portions 21', 21" without departing from the scope of the appended claims.

In particular, the pivot 20 having the concave portion 24 interposed between the convex curved portions of the ends 75, 76 of FIGS. 4 to 6B may be manufactured either in one piece or in the two half-portions 21', 21" without departing from the scope of the appended claims.

In a preferred but not exclusive embodiment, shown for example in FIGS. from 4 to 6B, between a seat 11 of the hinge body 10 wherein the pivot 20 is inserted and a portion 25 of the pivot facing thereto at least one bushing 26 may be interposed, made for example of polymeric material, for instance polytetrafluoroethylene. For example, the bushing 26 may be made of plastic material of high technology sold by IGUS.

The bushing 26 may include an outer surface 28' reciprocally facing the substantially cylindrical seat 11 of the hinge body 10 and an inner surface 28" reciprocally facing the portion 25 of the pivot 20.

Advantageously, braking means acting on the areas 26', 26", 26'" of the outer surface 28' of the bushing 26 may be provided to locally force the inner surface 28' of the same bushing 26 against the portion 25 of the pivot 20.

Figure 7:
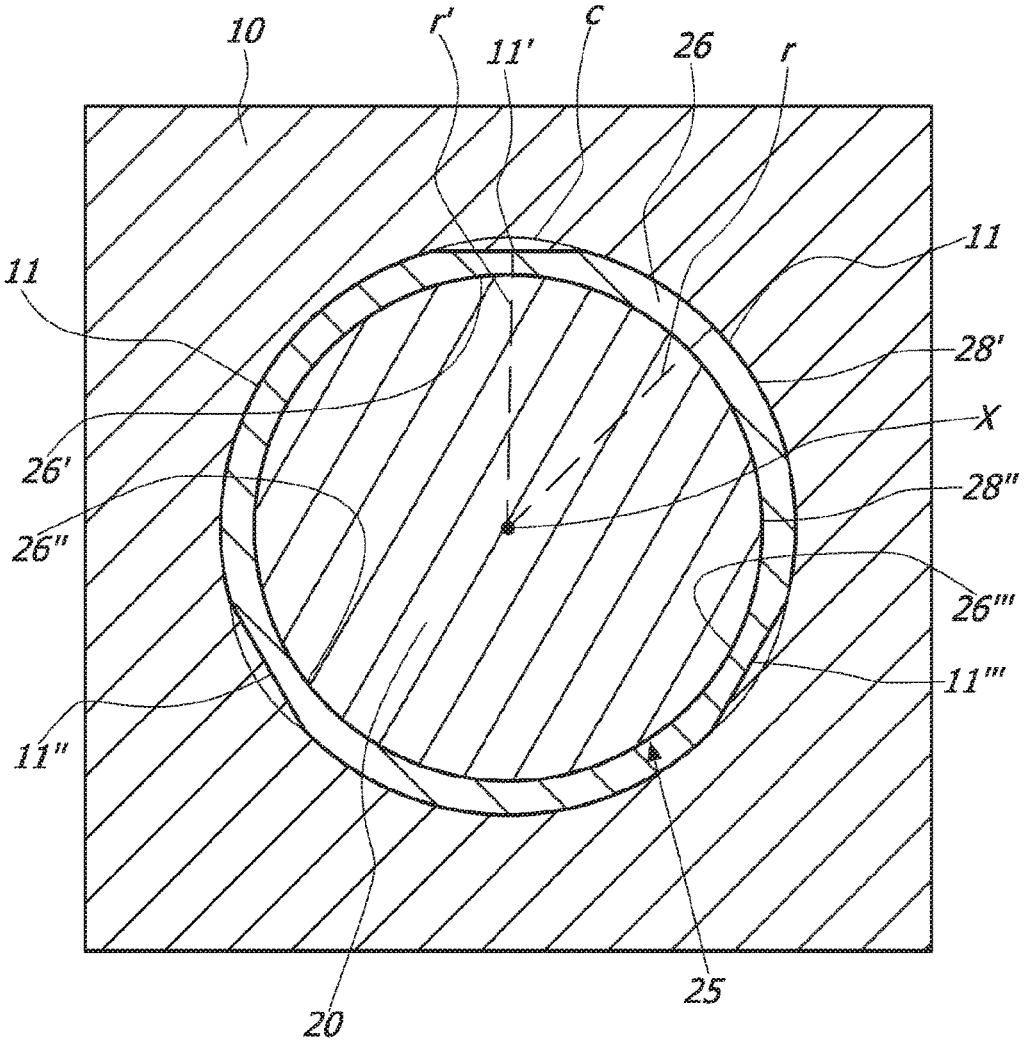
FIG. 7 is a sectioned view of some particulars of a further embodiment of the hinge 1.

In a preferred but not exclusive embodiment, shown for example in FIG. 7, the braking means may include, respectively, shaped portions 11', 11", 11'", for example flat, of the substantially cylindrical seat 11 of the hinge body 10 susceptible to act against the areas 26', 26", 26'" of the outer surface 28' of the bushing 26.

Suitably, the shaped portions 11', 11", 11'" may internally lie on a circumference C having its center on the axis X and radius r coincident with the radius of the substantially cylindrical seat 11 not taken in correspondence with the shaped portions 11', 11", 11'". For example, the radius r may be taken between the two consecutive portions 11', 11".

Consequently, the radius r' in correspondence with one of the shaped portions 11', 11", 11'" is less than the radius r not taken in correspondence with the shaped portions 11', 11", 11'".

In this way, the bushing 26 being locally deformed presses against the portion 25 of the pivot 20, by braking the rotatable movement of the latter around the axis X and then by braking the rotation of the closing element.

It is understood that the hinge 1 may include any number of shaped portions 11', 11", 11'", for example one, two or more than three, without departing from the scope of the appended claims.

In another preferred but not exclusive embodiment, the braking means may include a pair of adjusting screws 27 passing through the hinge body 10 and placed on opposite sides with respect to a plane parallel to both axes X and Y.

Each of the adjusting screws 27 may have an operative portion 29' accessible from outside by a user and a working portion 29" susceptible to come in contact engage with the areas 26', 26", 26'" of the outer surface 28' of the bushing 26 to locally force the inner surface 28" against the portion 25 of the pivot 20.

In this way, the user is able to brake in an adjustable manner the rotatable movement of the pivot 20 around the axis X. By acting on both the adjusting screws 27 it is possible to regulate the braking effect in a differentiated manner in the two directions of opening/closing of the closing element.

It is understood that the hinge 1 may also include only one of the adjusting screws 27, or more than two without departing from the scope of the appended claims.

It is also understood that the hinge 1 may include both the above-mentioned braking means without departing from the scope of the appended claims.

From the above description, it appears evident that the hinge according to the invention achieves the intended objects.

The hinge according to the invention is susceptible to numerous modifications and variations, all falling within the inventive concept expressed in the appended claims. All particulars may be replaced by other technically equivalent elements, and the materials may be different according to the needs, without exceeding the scope of the invention.

Even though the hinge has been shown with particular reference to the appended figures, the reference numerals used herein are to ameliorate the intelligence of the invention and do not constitute a limit of the protection claimed.

What is claimed is:

1. A closing hinge for a closing element, the hinge comprising:

a hinge body including a working chamber, the working chamber including a bottom wall;

a pivot, the pivot and the hinge body being rotatably coupled to each other for reciprocally rotating about a first longitudinal axis X of the pivot between a closed position of the closing element and a first and a second open positions of the closing element, opposite to each other with respect to the closed position, the working chamber having a second longitudinal axis Y perpendicular to the first longitudinal axis X;

wherein the pivot includes a cam;

wherein the working chamber includes a cam follower and a shaft extending along the second longitudinal axis Y, the shaft having a first end and a second end opposite to each other, the first end of the shaft facing the cam, the shaft including an apertured seat at the first end, the shaft comprising a wheel disposed within the hinge body and being rotatably mounted in the apertured seat to rotate about a third axis parallel to the first longitudinal axis X and spaced apart therefrom, the third axis intersecting the second longitudinal axis Y, the wheel including a round peripheral edge;

wherein the working chamber further includes a plunger disposed therein, the plunger and the second end of the shaft being connected to each other;

wherein the working chamber further includes a spring configured to urge the plunger to thrust the round peripheral edge of the wheel to engage with the cam;

wherein the cam is adapted to move the wheel along the second longitudinal axis Y from a position distal from the bottom wall of the working chamber, corresponding to the closed position of the closing element, to a position proximal thereto, corresponding to one of the first or second open positions of the closing element;

wherein the spring is adapted to slidably return the wheel along the second longitudinal axis Y from the proximal position to the distal position;

wherein the cam includes a first cylindrical pin and a second cylindrical pin respectively defining a fourth axis and a fifth axis spaced apart from the first longitudinal axis X and parallel thereto, the fourth axis and the fifth axis being a fixed distance from the first longitudinal axis, the first cylindrical pin including a first curved side wall, the second cylindrical pin including a second curved side wall;

wherein the first and second cylindrical pins are disposed at opposite sides with respect to the first longitudinal axis X, and the first and second curved side walls of the pins engage with the round peripheral edge of the wheel at a single point upon the reciprocal rotation of the pivot and the hinge body between the closed position of the closing element and the first open position thereof or between the closed position of the closing element and the second open position thereof, the first and second curved side walls defining a plane that is perpendicular to the second longitudinal axis Y when the closing element is in the closed position, wherein the round peripheral edge of the wheel and the first and second cylindrical pins interface so that the round peripheral edge of the wheel, in the first or the second open positions of the closing element, only contacts either the first curved side wall or the second curved side wall at a single respective first or second point and so that at the closed position of the closing element the round peripheral edge of the wheel contacts both the first curved side wall and the second curved side wall only at respective third and fourth points, the single first and second points being at opposite sides of first longitudinal axis X.

2. The hinge according to claim 1, wherein the wheel includes a central portion and two disk-shaped upper and lower portions adapted to interface with the respective curved side walls of the first and second cylindrical pins.

3. A closing hinge for a closing element, the hinge comprising:

a hinge body including a working chamber, the working chamber including a bottom wall;

a pivot, the pivot and the hinge body being rotatably coupled each other for reciprocally rotating about a first longitudinal axis X between a closed position of the closing element, and a first and a second open position opposite to each other with respect to the closed position of the closing element, the working chamber defining a second longitudinal axis Y perpendicular to the first longitudinal axis X;

wherein the pivot includes a cam;

wherein the working chamber includes a cam follower, the cam follower including a shaft extending along the second longitudinal axis Y, the shaft having a first end and a second end opposite to each other, the first end of the shaft facing the cam, the shaft including an apertured seat at the first end, the shaft comprising a wheel, rotatably mounted in the apertured seat to rotate about a third axis parallel to the first longitudinal axis X and spaced apart therefrom, the third axis intersecting the second longitudinal axis Y;

wherein the working chamber further includes a wheel with a round peripheral edge;

wherein the working chamber further includes a plunger disposed within the working chamber, the plunger and the second end of the shaft being connected to each other;

wherein the working chamber further includes a spring configured to urge the plunger to thrust the round peripheral edge of the wheel in contact with the cam;

wherein the cam is adapted to move the wheel along the second longitudinal axis Y from a position distal from the bottom wall of the working chamber, corresponding to the closed position of the closing element, to a position proximal thereto, corresponding to one of the first or second open positions of the closing element;

wherein the spring is adapted to slidably return the wheel along the second longitudinal axis Y from the proximal position to the distal position;

wherein the cam includes a first convex curved portion and a second convex curved portion disposed at opposite sides with respect to the first longitudinal axis X, the first and second convex curved portions being continuous surfaces free of depressions to thereby interface with the round peripheral edge of the wheel at a single point during reciprocal rotation of the pivot between the closed position of the closing element and the first open position of the closing element or between the closed position of the closing element and the second open position of the closing element, the first and second convex curved portions both being tangent to a common second plane perpendicular to the first longitudinal axis X of the pivot and perpendicular to the second longitudinal axis Y when the closing element is in the closed position, the cam further including a concave portion interposed between the first and the second convex curved portions;

wherein the round peripheral edge of the wheel and the first or second convex curved portions of the cam are mutually in contact and face each other so that at the first or the second open position of the closing element the round peripheral edge of the wheel only contacts either the first convex curved portion or the second convex curved portion in a respective first or second single point and so that in the closed position of the closing element the round peripheral edge of the wheel contacts both the first and the second convex curved portions of the cam, the first and second points being opposite with respect to the first longitudinal axis X.

4. The hinge according to claim 3, wherein the wheel includes a central portion and two disk-shaped upper and lower portions adapted to interface with the first and second convex curved portions.

5. The hinge according to claim 3, wherein the pivot is made of two half-portions to be removably coupled to each other, the pivot including a connector to mutually connect the two half-portions.

* * * * *